US006741030B2

(12) United States Patent
Klinedinst et al.

(10) Patent No.: US 6,741,030 B2
(45) Date of Patent: May 25, 2004

(54) CONTROL OF LEACHABLE MERCURY IN FLUORESCENT LAMPS

(75) Inventors: Keith A. Klinedinst, Hudson, MA (US); Dennis B. Shinn, Topsfield, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/175,572

(22) Filed: Jun. 19, 2002

(65) Prior Publication Data

US 2003/0234611 A1 Dec. 25, 2003

(51) Int. Cl.[7] ..... H01J 61/00; H01J 17/24

(52) U.S. Cl. ..... 313/565; 313/639; 313/490; 445/2; 445/61

(58) Field of Search ..... 313/565, 573, 313/634, 635, 639, 631, 566, 490–493; 445/2, 3, 14, 58, 61

(56) References Cited

U.S. PATENT DOCUMENTS 3,875,454 A * 4/1975 Van Der Wolf et al. .... 313/488
5,998,927 A 12/1999 Foust et al. ..... 313/565

* cited by examiner

*Primary Examiner*—Ashok Patel
(74) *Attorney, Agent, or Firm*—Carlo S. Bessone

(57) ABSTRACT

A method for inhibiting the leaching of mercury from a mercury vapor discharge lamp wherein at least a part of the mercury is present as ionic mercury includes depositing a coating of $SnO_2$ on an interior surface of the lamp envelope. The $SnO_2$ coating is substantially free of a substance which would cause electrical conductivity of the coating. Further included within the lamp is a quantity of oxidizable iron in an amount equal to at least 1 gram per kilogram of lamp weight.

6 Claims, No Drawings

CONTROL OF LEACHABLE MERCURY IN FLUORESCENT LAMPS

TECHNICAL FIELD

This invention relates to mercury vapor discharge lamps and more particularly to fluorescent lamps. Still more particularly it relates to lamps that can be landfilled without leaching potentially damaging mercury into the environment.

BACKGROUND ART

Fluorescent lamps contain elemental mercury. During lamp operation, chemical reactions take place that convert some of the elemental mercury to salts or compounds, such as mercuric oxide (HgO), that are water soluble. There is a growing concern that a waste stream resulting from the disposal of fluorescent lamps may leach excessive amounts of this soluble form of mercury (Hg) into the environment. An acceptable method of measuring the amount of soluble mercury which may leach from the waste stream resulting from the disposal of fluorescent lamps is described in the Toxicity Characteristic Leaching Procedure (TCLP) prescribed on pages 26987–26998 of volume 55, number 126 of the Jun. 29, 1990 issue of the Federal Register. The lamp to be tested is pulverized into granules having a surface area per gram of materials equal to or greater than 3.1 $cm^2$ or having a particle size smaller than 1 cm in its narrowest dimension. The granules are then subject to a sodium acetate buffer solution having a pH of approximately 4.9 and a weight twenty times that of the granules. The buffer solution is then extracted, and the concentration of mercury is measured. At the present time, the United States Environmental Protection Agency (EPA) defines a maximum concentration level for mercury to be 0.2 milligram of leachable mercury per liter of leachate fluid when the TCLP is applied. According to the present standards, a fluorescent lamp is considered nonhazardous (and thus available to be conventionally land-filed) when less than 0.2 milligram per liter of leachable mercury results using the TCLP. Lamps that have leachable mercury concentrations above the allowable limit must be especially disposed of through licensed disposal operations. Disposal operators charge a fee for disposal of lamps that are not within the EPA's limits. Therefore, customers must pay extra costs to dispose of these lamps. Customers of fluorescent lamps generally desire not to contend with disposal issues regarding mercury levels, and therefore some customers specify only those lamps which pass the TCLP standard.

Heretofore, efforts have been made to reduce the leaching of soluble mercury from fluorescent lamps during the TCLP testing as well as in landfills. Various methods have been proposed which attempt to treat or process burned-out discharge lamps or scrap lamp exhaust tubing containing mercury in order to reclaim the mercury and thereby reduce the amount of mercury-contaminated scrap.

U.S. Pat. No. 5,998,927, Foust, et al., teaches a method for inhibiting the formation of leachable mercury associated with a mercury arc vapor discharge lamp when the mercury is in elemental form The method comprises providing high-iron content metal components in the lamps, at least one of the high-iron content metal components having an amount of oxidizable iron of at least about 1 gm per kilogram of lamp weight.

What is not specifically addressed in the patent, however, is the situation in which practically all of the mercury may already be present in the soluble ionic form at the start of the TCLP testing, as a result of naturally occurring processes that take place within the fluorescent lamp during its operation.

DISCLOSURE OF INVENTION

It is, therefore, an object of the invention to obviate the disadvantages of the prior art.

It is another object of the invention to enhance the disposal of fluorescent lamps.

It is yet another object of the invention to allow conventional landfill disposal of fluorescent lamps of all diameters when the mercury contained therein is in the ionic form.

These objects are achieved, in one aspect of the invention, by the provision of a method for inhibiting mercury leaching from a mercury vapor discharge lamp wherein at least a part of said mercury is present as ionic mercury, and wherein the lamp includes an amount of oxidizable iron, the amount of iron being at least 1 gram per kilogram of lamp weight, and further depositing upon the inside surface of the glass lamp envelope a coating of tin oxide which is substantially free of a substance which would cause electrical conductivity of the coating. By "substantially free" is meant that the concentrations of substances that would cause the coating to become electrically conductive are approximately at or below normal impurity levels.

The addition of the tin oxide provides a totally unexpected, synergistic effect between the tin oxide and the oxidizable iron to inhibit mercury leaching when the mercury is present in an ionic form.

BEST MODE FOR CARRYING OUT THE INVENTION

For a better understanding of the present invention, together with other and further objects, advantages and capabilities thereof, reference is made to the following disclosure and appended claims.

Shown in Table I are the results of a series of TCLP tests carried out with F40T12 lamps in which all of the mercury (5.0–5.5 mg) was initially present in the soluble ionic form (added as HgO). The first test was run without the addition of any metallic iron. However, the second and third tests were run with the inclusion of 4.3 $cm^2$ of 0.15 mm thick metallic iron foil, while the forth and fifth tests were run with the inclusion of 6.4 $cm^2$ of 0.15 mm thick iron foil. These quantities of metallic iron correspond to approximately 1.8 to 2.7 grams of oxidizable iron per kilogram of lamp weight, well within the range prescribed by Foust, et al in the referenced patent. Also shown in the table are the concentrations of soluble iron (i.e., the concentrations of iron in the leaching solution) at the end of each test.

TABLE I

| Fe ($cm^2$) (Surface Area) | Initial Hg (mg, as HgO) | Final Soluble Hg (mg/l) | Final soluble Fe (mg/l) |
|---|---|---|---|
| 0 | 5.0 | 0.38 | 0.8 |
| 4.3 | 5.5 | 0.23 | 21 |
| 4.3 | 5.5 | 0.26 | 20 |
| 6.4 | 5.5 | 0.20 | 28 |
| 6.4 | 5.5 | 0.21 | 30 |

As shown in the table, the greater metallic iron surface area, the greater the soluble iron concentration and the lower the concentration of soluble mercury at the end of the TCLP. However, even with the inclusion of 6.4 $cm^2$ of oxidizable metallic iron, the resulting soluble mercury concentrations can lie above the maximum allowable concentration of leachable mercury, as determined via the TCLP. Also, it should be noted that the range of soluble iron concentrations determined in these tests is in essential agreement with that represented in the referenced Foust, et al. patent.

In order to reduce the voltage necessary for ignition of certain fluorescent lamps (in particular, certain T12 lamps that are no more than 4 feet in length), it is known in the art to deposit transparent and electrically conductive, doped $SnO_2$ upon the inside surfaces of the cylindrical glass lamp envelopes. The $SnO_2$ is typically doped with fluorine (F) or antimony (Sb) (most typically fluorine), which dopants have the effect of greatly increasing the electrical conductivity of the material.

Previous TCLP testing of otherwise identical mercury-containing fluorescent lamps which either do or do not contain such conductive (F-doped) $SnO_2$ coatings on the inside surfaces of the glass envelopes have shown that the F-doped $SnO_2$ coating does not affect significantly the results of TCLP testing. I.e., such coatings have little or no effect upon the amount of mercury dissolved within the extraction fluid at the end of the TCLP test. This result is demonstrated in Table II wherein are listed the results of two TCLP tests carried out with F40T12 lamps in which all of the mercury (5 mg) was initially present in the soluble ionic form (added as HgO). The first test was run with a lamp with a lamp which did not contain an $SnO_2$ coating on the glass (similar to the first test listed in Table I above), while the second test was run with glass that had been coated on the inside surface with F-doped $SnO_2$. As shown, the presence of the conductive, F-doped $SnO_2$ coating had essentially no effect upon the result of the TCLP test.

TABLE II

| F-Doped $SnO_2$ Coating | Final Soluble Hg (mg/l) |
|---|---|
| No | 0.38 |
| Yes | 0.37 |

In view of these results, it was surprising to discover that the combination of a F-doped $SnO_2$ coating with a relatively small amount of oxidizable metallic iron (as used in the TCLP testing described above, Table I) is particularly efficacious in the reduction of extractable ionic mercury during the TCLP.

The apparent synergy between F-doped $SnO_2$ and relatively small quantities of oxidizable metallic iron is demonstrated in Table III below. Here, standard TCLP tests were run using a T12 glass envelope with or without the standard F-doped $SnO_2$ coating. In each case, a test was run with and without the presence of 6.4 $cm^2$ of 0.15 mm thick metallic iron foil. 4.5 mg of ionic mercury (as HgO) was also included in each test. The quantity of TCLP fluid was typical of that used in the TCLP test of a T12 fluorescent lamp (5.6 l). (A thin layer of fumed alumina was also present on the inside surface of each F-doped $SnO_2$ coating, as is common in the manufacture of fluorescent lamps).

TABLE III

| F-Doped $SnO_2$ | Fe Foil (6.4 $cm^2$) | Final Soluble Hg (mg/l) | Final Soluble Fe (mg/l) |
|---|---|---|---|
| No | No | 0.89 | <0.03 |
| Yes | No | 0.88 | <0.03 |
| No | Yes | 0.61 | 29 |
| Yes | Yes | 0.06 | 27 |

To determine if the other transition metals were as efficacious as iron in the removal of ionic mercury, another series of tests was run employing these metals and glass coated with F-doped $SnO_2$. In each test, 6.4 $cm^2$ of the substituted metal was employed. As shown by the results in Table IV, all other transition metals were relatively ineffective in inhibiting the leaching of ionic mercury.

TABLE IV

| Metal | Final Soluble Hg (mg/l) |
|---|---|
| Iron | 0.04 |
| Cobalt | 0.45 |
| Copper | 0.50 |
| Nickel | 0.68 |

Additional TCLP tests were run in the same way as were those described above, except that the quantities of metallic iron foil and of F-doped $SnO_2$-coated glass were varied. The results of these tests are compared in Table V. As shown, the quantity of metallic iron foil that effectively prevents mercury leaching, as measured by the TCLP, decreases with increasing surface area of F-doped $SnO_2$-coated glass. And, similarly, the quantity of $SnO_2$-coated glass required to effectively prevent mercury-leaching decreases as the amount of oxidizable metallic iron foil increases.

TABLE V

| | F-Doped $SnO_2$ Glass Area ($ft^2$) | | |
|---|---|---|---|
| Fe Area ($cm^2$) | 0 | 1 | 1.5 |
| 0 | 0.89 | — | 0.88 |
| 0.2 | — | — | 0.75 |
| 1 | — | 0.75 | 0.05 |
| 6.4 | 0.61 | 0.06 | 0.07 |

The effectiveness of the synergy between F-doped $SnO_2$ ands metallic iron in effecting the TCLP compliancy of a fluorescent lamp is demonstrated in Table VI. Listed here are the results of TCLP tests carried out with F40D35 lamps both with and without the standard F-doped $SnO_2$ coating on the inside diameter of the glass envelope. For each of these two cases, TCLP results are shown for tests run which included 4.3 $cm^2$ of 0.15 mm thick metallic iron foil along with 5.5 mg of soluble ionic mercury (as HgO). The effectiveness of the metallic iron/F-doped $SnO_2$ synergy in promoting the reduction of soluble ionic mercury in the TCLP is apparent.

TABLE VI

| F-Doped $SnO_2$ Coated | Final Soluble Hg (mg/l) |
|---|---|
| No | 0.23 |
| No | 0.23 |

TABLE VI-continued

| F-Doped $SnO_2$ Coated | Final Soluble Hg (mg/l) |
|---|---|
| No | 0.24 |
| No | 0.26 |
| Yes | 0.16 |
| Yes | 0.16 |
| Yes | 0.17 |

While the results of the above-tests are startling as regards the removal of ionic mercury, there are serious disadvantages associated with the use of F-doped coatings, both in the manufacture and operation of fluorescent lamps. Hydrofluoric acid (HF) is typically used as a relatively inexpensive source of fluoride. A concentrated aqueous solution of HF is mixed with the other coating-solution components (typically $SnCl_4$, water, and alcohol), and the resulting mixture is sprayed onto the inside surface of the preheated glass tube. In addition to the concentration-dependent corrosive effect that HF shares with other strong acids, there is an additional extreme toxicity effect due to the fluorine. A specific property of fluoride is that is readily penetrates human skin, allowing it to destroy soft tissue and decalcify bone. The toxic effect is due to the precipitation of the available bodily calcium by the fluoride. This typically leads to a drastic drop of the calcium level, essential for most vital functions. If not promptly treated, often-fatal complications may follow (e.g., cardiac arrest). It would obviously be advantageous if the fluoride content of the $SnO_2$ coating could be eliminated without significantly altering the beneficial effects of the coating.

The presence of the fluoride dopant in the $SnO_2$ coating also exacerbates the formation of a type of lamp defect often referred to as 'black spot patches' or 'measles' which develop during lamp operation as a result of an interaction involving the conductive layer and the mercury in the arc discharge. The mercury penetrates the phosphor layer, leading to conditions that allow buildup of charge and subsequent discharge, which result in the 'measle' defect by disrupting the phosphor layer and generally forming a small crater in the glass tube. In particular, the formation of 'measles' is believed to be caused by the presence of salts in the conductive layer, salts which are formed largely by reaction between the fluoride in the conductive tin-oxide coating solution and sodium in the glass. For this reason, also, it would be advantageous if the fluoride content of the $SnO_2$ coating could be eliminated without significantly altering the beneficial effects of the coating.

What is disclosed herein is a method for inhibiting the leaching of mercury from mercury-containing fluorescent lamps, as determined by the TCLP. The method comprises providing an amount of oxidizable iron, the amount of iron being at least 1 gram per kilogram of lamp weight, and further depositing upon the inside surface of the glass lamp envelope a coating of tin oxide which is substantially free of a substance which would cause electrical conductivity of the coating. By "substantially free" is meant that the concentrations of substances that would cause the coating to become electrically conductive are approximately at or below normal impurity levels.

PREPARATION

The inside surfaces of two groups of standard T12 lamp envelopes about 1.5 inches in diameter and about 4 feet in length were coated with tin oxide ($SnO_2$) using the standard spraying method with standard $SnCl_4$ and solvent concentrations used in each case. In one case, the sprayed solution also contained the standard concentration of hydrofluoric acid (HF). In the other case the tubes were coated using an $SnCl_4$ solution which did not contain any HF. Both groups of lamp envelopes were coated with the standard thickness of $SnO_2$.

After being subjected to the standard baking operation (designed to fuse the $SnO_2$ layer to the inside surface of the glass tube), the relative resistivities of the undoped and F-doped coatings were determined using point probes positioned close to the ends of the coated surfaces of each tube. The relative end-to-end film resistance of the undoped $SnO_2$ coating was found to be between 3 and 4 times that of the F-doped coating.

The coated surfaces also were examined analytically by two methods: energy dispersive spectroscopy (EDS) and Rutherford backscattering spectroscopy (RBS). Taken together, the results of these measurements indicated an average film thickness of about 50 mm (corresponding to a coating density of approximately 40 micrograms/$cm^2$).

EXAMPLE I

Two TCLP tests were run, in each case using a T12 glass lamp envelope, 6.4 $cm^2$ of 0.15 mm thick metallic iron foil, and 4.5 mg of ionic mercury (as HgO). A 5.6 liter volume of TCLP extraction fluid was used in each case (the amount of fluid used in a typical T12-lamp TCLP test). A T12 glass tube with an undoped $SnO_2$ coating was used in the first test, while an uncoated tube was used in the other test. The results of these TCLP tests are listed in Table VII. As shown, an extracted mercury concentration well below the critical 0.2 mg/l value was obtained in the test run with the $SnO_2$-coated T12 glass. In contrast, an extracted mercury concentration well above the 0.2 mg/l 'passing' level was obtained when the uncoated glass was used.

TABLE VII

| Undoped $SnO_2$ Coating | Final Soluble Hg (mg/l) |
|---|---|
| Yes | 0.07 |
| No | 0.63 |

EXAMPLE II

Two other TCLP tests were run, in each case using a 1 $ft^2$ area of plate glass, 6.4 $cm^2$ of 0.15 mm thick metallic iron foil, and 4.5 mg of ionic mercury (as HgO). The glass used in one of the two tests was coated on one side with undoped $SnO_2$. As in example I, a 5.6 l volume of TCLP extraction fluid was used in each test. The resistivity of the undoped $SnO_2$ coating was found to be 5-to-6 times that of a $SnO_2$ coating of approximately the same thickness deposited using the standard F-dopant concentration. The results of these two TCLP tests are listed in Table VIII. As shown, an extracted mercury concentration well below the critical 0.2 mg/l value was obtained in the test carried out with undoped-$SnO_2$-coated glass. In contrast, an extracted mercury concentration much greater than the 0.2 mg/l 'passing' level was obtained when uncoated glass was used.

TABLE VIII

| Undoped $SnO_2$ Coating | Final Soluble Hg (mg/l) |
|---|---|
| Yes | 0.04 |
| No | 0.55 |

EXAMPLE III

A series of TCLP tests were run with standard F40D830 lamp components (phosphors deposited on the inside surfaces of the T12 glass tubes, aluminum endcaps, tungsten filaments with nickel-plated iron mounts, and copper-plated outer leads with brass connecting pins). However, while some of the glass lamp envelopes were manufactured with the standard F-doped $SnO_2$ coating, others were coated with undoped $SnO_2$, and some had no $SnO_2$ at all. Included in each test were 4.3 $cm^3$ of oxidizable metallic iron foil and 4.5 mg of ionic mercury (as HgO). The average final soluble mercury and iron concentrations obtained in these tests are listed in Table IX. As shown, an extracted mercury concentration well below the critical 0.2 mg/l value was obtained when glass coated either with undoped $SnO_2$ or with F-doped $SnO_2$ was used, while extracted mercury concentrations greater than the 0.2 mg/l 'passing' level were obtained with uncoated glass. However, the amount of oxidized iron dissolved in the extraction fluid was nearly the same in each case.

TABLE IX

| $SnO_2$ Coating | Final Soluble Hg (mg/l) | Final Soluble Fe (mg/l) |
|---|---|---|
| None | 0.21 | 19 |
| F-doped | 0.16 | 21 |
| Undoped | 0.14 | 20 |

As shown by the above examples, the improved method for the control of leachable mercury in a fluorescent lamp is based upon the surprising synergy that exists between a coating of tin oxide (deposited upon the inside surface of the lamp's glass envelope) in which the concentrations of substances that would cause the coating to become electrically conductive are approximately at or below normal impurity levels and a relatively small amount of oxidizable metallic iron or other high-iron content metal, to inhibit mercury leaching. Intended to be included within the scope of this method are situations in which there may possibly be slight accidental doping of the tin oxide by impurities which inadvertently may be present within the coating-precursor solution. The high-iron content metal could be included within the lamp in a variety of ways, as suggested by the prior art.

While a number of attempts have been made to determine experimentally the mechanism responsible for the surprising synergy between $SnO_2$ and oxidizable metallic iron, no completely satisfactory explanation has emerged. Nevertheless, the following hypothetical explanation is offered which is at least consistent with all of the known facts:

Step 1) Metallic iron oxidizes and dissolves in the acidic extraction fluid as $Fe^{2+}$.

Step 2) The dissolved ferrous iron adsorbs upon the surface of the $SnO_2$-coated glass.

Step 3) Dissolved ionic mercury ions also adsorb upon the $SnO_2$-coated glass surface.

Step 4) The adsorbed ferrous iron and mercury ions interact on the surface of the $SnO_2$-coated glass to effect the oxidation of the ferrous iron (to $Fe^{2+}$) with the corresponding reduction of ionic mercury to the essentially insoluble elemental form.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A method for inhibiting leaching of mercury from a mercury vapor discharge lamp having an envelope wherein at least a part of said mercury is present as ionic mercury, said method comprising:

including within said lamp a layer of $SnO_2$ deposited as a coating upon an interior surface of said envelope, said coating of $SnO_2$ being substantially free of a substance which would cause electrical conductivity of said coating; and including within said lamp an amount of oxidizable iron, said amount of iron being at least 1 gram per kilogram of lamp weight.

2. The method of claim 1 wherein said ionic mercury is present as mercury oxide.

3. The method of claim 1 wherein said coating of $SnO_2$ has a density of about 40 micrograms/$cm^2$.

4. In an arc discharge lamp having an envelope and including ionic mercury and at least one component comprised of oxidizable iron in an amount of at least 1 gram per kilogram of lamp weight, the improvement comprising: a layer of $SnO_2$ deposited on an interior surface of said envelope as a coating, said coating of $SnO_2$ being substantially free of a substance which would cause electrical conductivity of said coating.

5. The lamp of claim 4 wherein said ionic mercury is present as mercury oxide.

6. The lamp of claim 4 wherein said coating of $SnO_2$ has a density of about 40 micrograms/$cm^2$.

* * * * *